United States Patent [19]

Casillo

[11] 4,107,953

[45] Aug. 22, 1978

[54] CROCHETING TOOL

[76] Inventor: Santo Casillo, 9604 156th Ave., Howard Beach, N.Y. 11414

[21] Appl. No.: 834,333

[22] Filed: Sep. 19, 1977

[51] Int. Cl.[2] ..... D04B 35/00; D04B 37/00

[52] U.S. Cl. ..... 66/1 R; 112/80; 112/169; 66/116

[58] Field of Search ..... 66/1 R, 1 A, 1.5, 4, 66/3, 116, 117; 112/80, 169

[56] References Cited

U.S. PATENT DOCUMENTS

| | | | |
|---|---|---|---|
| 889,922 | 6/1908 | Garret | 112/80 |
| 1,389,115 | 8/1921 | Bassisty | 112/80 |
| 2,135,142 | 11/1938 | Obermayr | 66/2 |
| 2,169,528 | 8/1939 | Heffron | 112/169 |
| 2,276,062 | 3/1942 | Peyser | 66/1 A |
| 2,928,363 | 3/1960 | Saltz et al. | 112/169 |
| 3,165,080 | 11/1965 | Castelletti | 112/169 X |
| 3,435,789 | 4/1969 | Kuramochi | 112/169 |

*Primary Examiner*—Ronald Feldbaum
*Attorney, Agent, or Firm*—Amster & Rothstein

[57] ABSTRACT

A semi-automatic crocheting tool has a chassis including a yarn-receiving assembly with a hook, a needle normally spaced from the hook, and means for selectively engaging and disengaging the needle from the hook. The tool has a counting feature which automatically counts the number of times the needle engages the hook, and thus keeps an accurate record of the number of stitches completed. Additionally, a manual counting device facilitates multiplying the maximum number of stitches up to which the automatic device can count, or, in the alternative, allows for both the number of stitches and the numbers of rows of stitches to be recorded.

9 Claims, 11 Drawing Figures

CROCHETING TOOL

The present invention relates generally to a semi-automatic crocheting tool which provides for the automatic counting of the number of stitches completed, which allows yarn to be fed through a hollow needle, and which facilitates the production of uniform stitches.

Crocheting, the needles and the art of crocheting are well known. In the conventional crocheting process, the yarn is directed by means of a solid needle including a hook at one end. The operator manipulates the yarn using this hook to form a variety of stitches. One difficulty with such equipment is that the unskilled or semi-skilled operator is inclined to forget the number of stitches completed along a particular row, and, therefore, to create uneven or misaligned products. Another difficulty with conventional crocheting equipment is that the working segment of the yarn has a tendency to become intermingled with the finished product, resulting in the completion of the finished product taking more time and being more difficult. A further limitation of conventional crocheting equipment is that such equipment, in the hands of a less than skilled operator, may produce stitches of non-uniform size resulting in uneven garments.

It is an overall object of the present invention to provide a crocheting apparatus that overcomes these and other disadvantages of prior art crocheting devices; specifically it is an object of the present invention to provide an apparatus which automatically counts the number of stitches completed, thus avoiding the necessity of having the operator keep mental track of the number of stitches completed.

It is a further object of the present invention to provide a crocheting tool including a manual counting device, complimenting the automatic counting feature, thus multiplying the maximum number of stitches up to which the tool can count, or, in the alternative, allowing both the number of stitches and number of rows of stitches to be counted.

It is a still further object of the present invention to provide a crocheting tool which, by directing the yarn through a hollow needle, reduces the instances of intermingling of the finished product with the working segment of the yarn.

It is a still further object of the present invention to provide a crocheting tool which allows an unskilled or semi-skilled operator to produce uniform stitches of a desired size.

In accordance with an illustrative embodiment demonstrating objects and features of the present invention, there is provided a semi-automatic crocheting tool, including a chassis having a yarn-receiving assembly, a needle normally spaced from said yarn-receiving assembly, and means for selectively engaging and disengaging the needle from the yarn-receiving assembly. The yarn-receiving assembly includes a horizontal arm having a recess in its bottom face, and a hook normally biased to be adjacent with the horizontal arm, thus forming a cavity of sufficient dimension to retain the yarn being used. The hook further includes, as translating means, a camming surface mounted in the path of the needle, facilitating the opening and closing of the hook. The needle comprises a tubular member and includes an eye transverse to the axis of the tubular member at its end nearest the hook. By means of a projection directed through a laterally extending slot in the chassis, the needle can be manipulated towards a first position in engagement with the hook, and a second position remote from the hook. Stitches are formed by the engagement of the needle with the hook, with the hook retaining the yarn in position when closed. The path of travel of the needle, and thence the size of the stitch, can be adjusted by means of a movable stop-piece mounted within the laterally extending slot, said movable stop-piece being placed adjacent the projection at the end remote from the needle. Attached as an integral member of the needle is a flexible actuator. Mounted in the path of this flexible actuator is a ratchet gear constructed and arranged so that it can be advanced one position by each engagement of the flexible actuator. The outer periphery of the ratchet gear includes numbers sequentially positioned thereon, said numbers being visible through a window in the chassis. A pawl prevents the ratchet gear from retreating as the needle is retracted.

A dial is also mounted to the chassis, and also is visible through a window included in the chassis. This dial is manipulatable by the operator, and aids the operator in multiplying the number of complete revolutions of the ratchet gear and thus multiplying the maximum number of stitches which can be automatically counted by the tool. In the alternative, the dial can be used to count in both dimensions, that is, to count both the number of stitches completed and the number of rows of stitches.

The above brief description of the present invention will be more fully appreciated by reference to the following detailed description of a presently preferred, but nonetheless illustrative embodiment in accordance with the invention, when taken in conjunction with the accompanying drawings, wherein.

Figure 1:
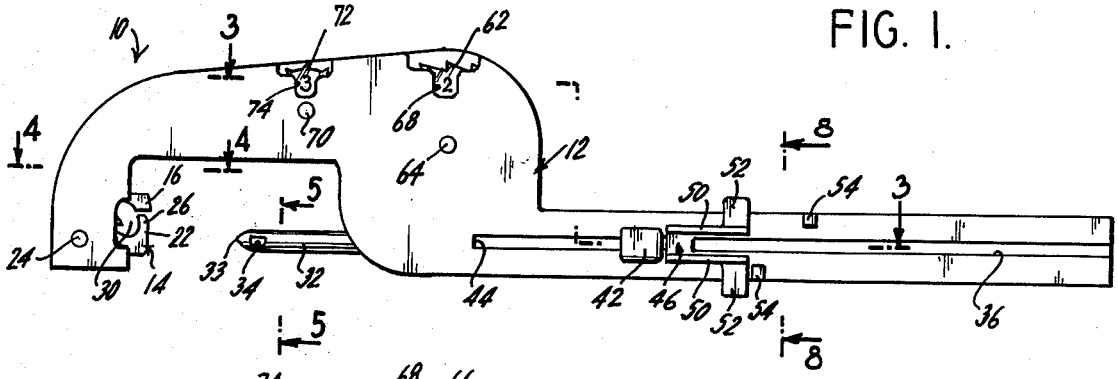
FIG. 1 is a side elevational view of a crocheting tool made in accordance with the present invention.

Referring now to FIG. 1, a crocheting tool manufactured in accordance with the present invention is generally designated by the reference numeral 10. Crocheting tool 10 comprises chassis 12, which at its left-most end employs a yarn-receiving assembly generally designated as 14. As can be seen by reference to FIG. 2, yarn-receiving assembly 14 generally includes support arm 16, which includes recess 18 in its bottom face.

Figure 6:
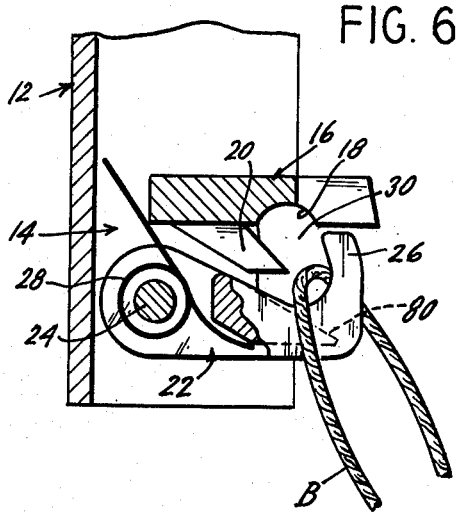
FIG. 6 is an enlarged view of the yarn-receiving assembly with the needle in its second or retracted position.
Figure 7:
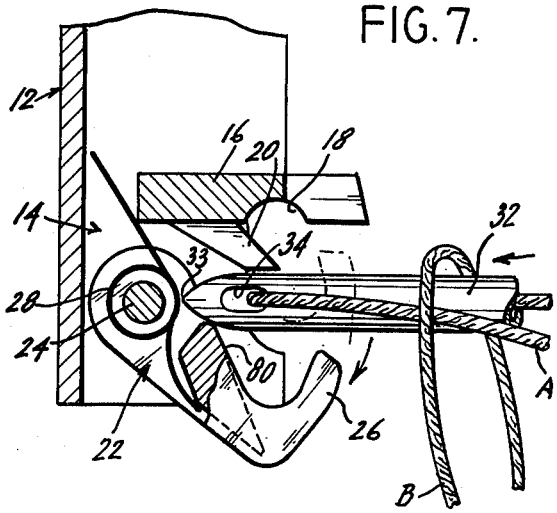
FIG. 7 is an enlarged view of the yarn-receiving assembly with the needle in its first or engaged position, with one stitch having been completed.

Mounted to support arm 16 at an acute angle is support arm 20. Hook 22 is pivotally mounted to chassis 12 about shaft 24, and includes extension 26. Hook 22 is maintained in position so that extension 26 is normally adjacent to support arm 16 by a biasing means, spring 28, as shown in FIGS. 6 and 7. With hook 22 in this position, extension 26 combines with recess 18, to form cavity 30.

Figure 3:
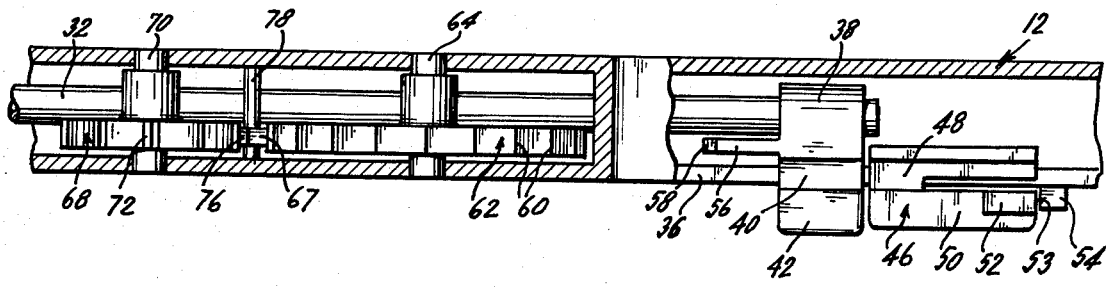
FIG. 3 is a sectional view of the tool taken along line 3—3 of FIG. 1.

Needle 32, which includes transverse eye 34, is slidably mounted within chassis 12. As best seen in FIG. 1, chassis 12 further includes laterally extending slot 36. Mounted to needle 32 at the end remote from transverse eye 34, is yoke 38, which is dimensioned to fit freely within chassis 12 as can be seen by reference to FIG. 8. Yoke 38 is mounted to knob 42 through shaft 40 as shown in FIG. 3. Shaft 40 is of a smaller vertical dimension than laterally extending slot 36, allowing knob 42 to slide freely along the path of laterally extending slot 36. Thus, the lateral deflection of knob 42 causes a corresponding lateral deflection of needle 32, and allows for the selective engagement and disengagement or retraction of needle 32 with respect to yarn-receiving assembly 14.

Figure 8:
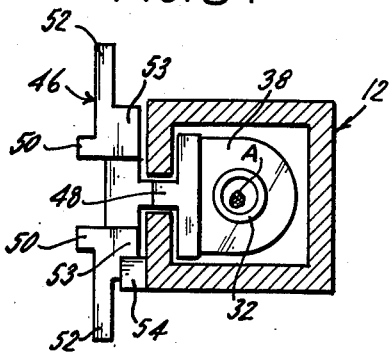
FIG. 8 is a sectional view taken along line 8—8 of FIG. 1.

The period of movement of knob 42, and consequently of needle 32, is bounded at its left-most end (as shown on FIG. 1) by end 44 of slot 36, and its right-most end by stop-piece 46. Stop-piece 46 is generally H-shaped in cross section as can be seen in FIG. 8. Center portion 48 of stop-piece 46 is of a smaller vertical dimension than laterally extending slot 36, thus allowing for the free movement of stop-piece 46 with respect to laterally extending slot 36. Resilient arms 50 extend back along the periphery of laterally extending slot 36 and are mounted to stop-piece 46. Members 52 are mounted to resilient arms 50 at the end remote from stop-piece 46, and include steps 53 as shown in FIG. 8. Bosses 54 are mounted along the periphery of laterally extending slot 36 as shown in FIG. 1, and are positioned to interfere with the lateral deflection of steps 53 when resilient arms 50 are in their normal position as shown in FIG. 1. Compressive force on members 52 causes resilient members 50 to deform, allowing steps 53 to pass around bosses 54 and thus stop-piece 46 to be moved laterally along slot 36. Thus, stop-piece 46 can be selectively abutted against any of bosses 54, providing a movable terminus for the period of movement of knob 42, and therefore of needle 32. This allows the stitch size to be varied while at the same time ensuring that stitches of a particular desired size will be uniform.

Figure 2:
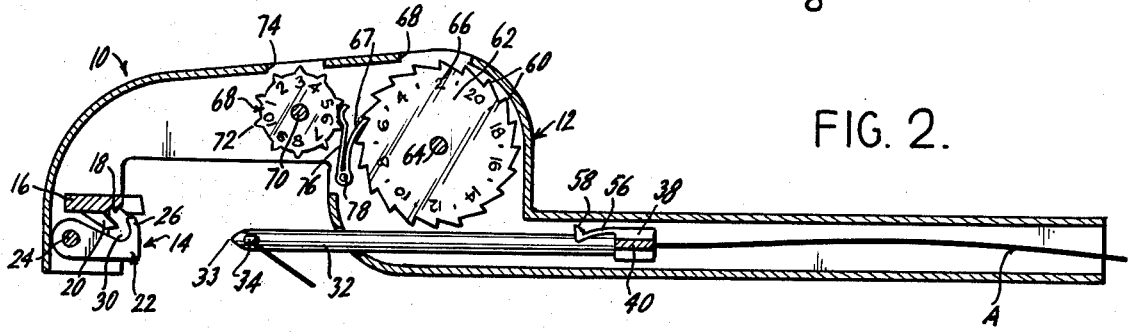
FIG. 2 is a side elevational view of the tool with its side face removed, showing interior construction details.

Means for counting the mumber of selective engagements and retractions of needle 32 with respect to yarn-receiving assembly 14 is provided by means of flexible actuator 56 mounted to yoke 38. Flexible actuator 56 includes catch 58 at its end remote from yoke 38. Catch 58 is positioned on yoke 38 to cause it to engage teeth 60 of ratchet gear 62 as shown in FIG. 2. Ratchet gear 62 is rotatably mounted to chassis 12 through shaft 64, and includes numbers 66 sequentially positioned along its outer periphery, said numbers 66 being visible through window 68 at the upper extremity of chassis 12 as shown in FIG. 1. Leftward movement of knob 42 urges needle 32 towards yarn-receiving assembly 14, and causes catch 58 to engage one of the teeth 60 of ratchet gear 62, advancing ratchet gear 62, and thus increasing the number visible through window 68, one position. Ratchet gear 62 is prevented from retracting by the action of pawl 66. As needle 32 is retracted, catch 58 engages the back end of one of teeth 60 of ratchet gear 62 but pawl 66 prevents ratchet gear 62 from counter rotating; flexible actuator 56 deflects, allowing catch 58 to slide along teeth 60 of gear 62. Thus, the counting mechanism only advances with each movement of needle 32 towards yarn-receiving assembly 14, and remains in place as needle 32 retracts.

As can be seen by reference to FIG. 2, there is a limit to the number of numbers 66 which can be included along the outer periphery of ratchet gear 62. To increase the tool's automatic capacity for counting, there is further included dial 68 mounted to chassis 12 through shaft 70. Dial 68 includes points 72, which are manipulatable through window 74 in chassis 12, as shown in FIG. 1. Dial 68 is independent of the movement of needle 32, and as ratchet gear 62 automatically advances through one complete rotation, the operator may manually advance dial 68 by manipulating a point 72 through window 74. Pawl 76 which is mounted to chassis 12 at point 78 urges against the outer periphery of dial 68, thus allowing the operator to advance dial 68 one position at a time. This allows for numbers 80, which are visible through window 74, to advance, thus counting the number of complete revolutions of ratchet gear 62.

Figure 4:
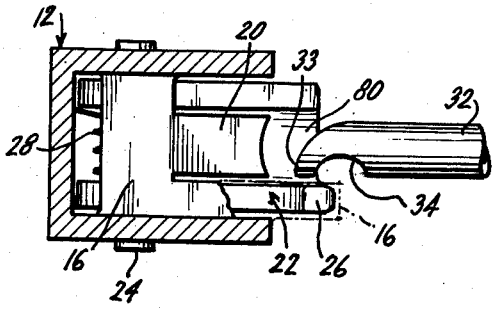
FIG. 4 is an enlarged sectional view taken along line 4—4 of FIG. 1.
Figure 5:
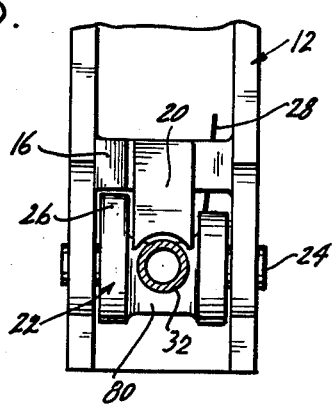
FIG. 5 is an enlarged sectional view taken along line 5—5 of FIG. 1.

As needle 32 is urged towards yarn-receiving assembly 14, point 33 of needle 32 communicates with a translating means, camming surface 80 of hook 22 as shown in FIG. 4. Camming surface 80 is adjacent to extension 26 of hook 22, and as needle 32 urges against camming surface 80, extension 26 is urged away from horizontal arm 16 as shown in FIG. 7. As needle 32 is withdrawn from communication with camming surface 80, spring 28 urges extension 26 back towards its normal position adjacent support arm 16 as shown in FIG. 6.

To form a stitch the operator initially threads a length of yarn through needle 32, out transverse eye 34 and forms this portion of yarn A into a priming loop (not shown). Needle 32 is passed through the priming loop into engagement with camming surface 80 of hook 32. By this action, extension 26 is urged away from its position widening cavity 30 enabling it to receive yarn A. Needle 32 is then retracted, allowing spring 28 to urge extension 26 back into its normal position thus restraining yarn A in place and forming loop B as shown in FIG. 6. Needle 32 is further retracted through the priming loop, thus forming a first stitch.

Needle 32 is then urged through loop B into engagement with hook 22 as shown in FIG. 7. When needle 32 is retracted from hook 22 and through loop B, with hook 22 retaining a segment of yarn A, a second stitch is formed. Repeating this process will form a one dimensional row of stitches as in row $a_1$–$a_8$ of FIG. 9.

Figure 9:
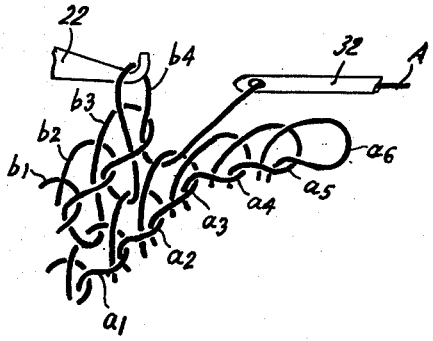
FIG. 9 is a schematic view of stitches formed by the tool with stitch $b_4$ having just been formed.
Figure 10:
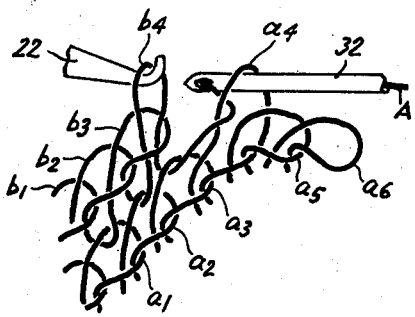
FIG. 10 is a further schematic view of stitches formed by the tool with stitch $b_4$ about to be joined to stitch $a_4$.
Figure 11:
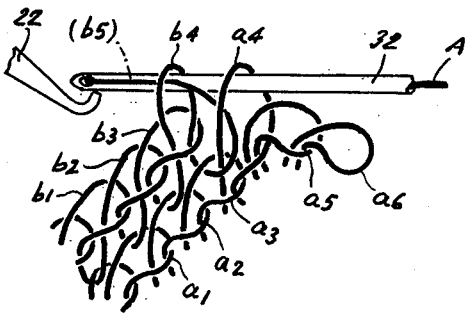
FIG. 11 is a schematic view of stitches having been formed by the tool with stitch $b_5$ about to be formed.

Reference to FIGS. 9, 10 and 11 will show the progression of stitches made by a crocheting tool embodying the pressent invention.

Turning to FIG. 9, needle 32 is in its second or retracted position away from hook 22, and a first row of stitches ($a_1$–$a_6$) has been formed as described above.

As indicated by reference to FIG. 10, one loop ($a_4$) of the A-row is manipulated around hook 22 and yarn A. Needle 32 is next urged towards hook 22 and by action of needle 32 against camming surface 80 of hook 22, as described above, extension 26 is urged away from its normal position, loop $b_4$ is withdrawn along needle 32, and loop $b_5$ is ready to be formed, as can all be seen by reference to FIG. 11. Repetition of this pattern allows the operator to manufacture a two-dimensional arrary of stitches.

By co-action of needle 32 (through flexible actuator 56 and catch 58) and ratchet gear 62 as described above, the tool records the number of stitches formed and thus allows the operator to create a symmetrical and properly aligned product. The maximum number of stitches that can be counted by combining the action of ratchet gear 62 with the manual operation of dial 68 is obtained by multiplying the largest number on dial 68 by the largest number on gear 62.

In the alternative, the operator could use ratchet gear 62 and dial 68 independently, one to keep track of each dimension of stitches. For example, turning to the stitches being formed in FIGS. 9, 10 and 11, ratchet gear 62 could be used to keep track of the number of stitches in a row ($a_1$, $a_2$, $a_3$) and by manual operation dial 68 could keep track of the number of rows (*a, b, c* ..).

Although the invention has been described in terms of a specific embodiment for illustrative purposes, it will be appreciated by one skilled in the art that many additions, subtractions and modifications are possible without departing from the spirit and scope of the invention as defined in the accompanying claims and therefore the appended claims are to be broadly construed.

What is claimed is:

1. A crocheting tool comprising a chassis including yarn-collecting means for receiving and retaining a segment of yarn, a needle slidably mounted in said chassis, positioning means adapted to reciprocate said needle relative to said chassis between a first position in engagement with said yarn-collecting means and a second position remote from said yarn-collecting means, and counting means mounted in said chassis for recording the number of reciprocations of said needle, said counting means comprising a rachet gear rotatably mounted to said chassis and having numerals sequentially printed at its periphery, a resilient actuator mounted to said needle and located to advance said rachet gear as said needle moves from said second position to said first position, and a pawl engaging said rachet gear, said pawl being constructed and arranged to prevent said rachet gear from counter-rotating as said needle moves from said first position to said second position.

2. Apparatus in accordance with claim 1 wherein said yarn-collecting means comprises a support arm including a recess, a hook pivotally mounted to said chassis in engaging relationship with said support arm, said hook and said recess combining to define a cavity and biasing means for urging said hook to remain normally adjacent to said support arm.

3. Apparatus in accordance with claim 2 wherein said hook further includes: translating means for receiving said needle and simultaneously urging said hook away from said support arm.

4. Apparatus in accordance with claim 3 wherein said translating means comprises a camming surface included on said hook in the path of said needle.

5. Apparatus in accordance with claim 1 wherein said counting means further comprises a manually operated indicating means.

6. Apparatus in accordance with claim 1 wherein said needle is comprised of a tubular member and includes an eye transverse to the axis of said tubular member at its end adjacent said yarn-collecting means.

7. Apparatus in accordance with claim 1 wherein said chassis further includes a longitudinally extending slot generally parallel to said needle, and said positioning means comprises a projection on said needle, said projection being slidingly engaged in said slot whereby reciprocation of said projection causes said needle to move between said first position and said second position.

8. Apparatus in accordance with claim 7 wherein said positioning means further comprises a stop-piece adjustably mounted within said slot and constructed and arranged so that said stop-piece limits the reciprocation of said needle as said needle moves from said first position to said second position.

9. A crocheting tool comprising a chassis, a needle slidably mounted in said chassis, a yarn-receiving assembly mounted to said chassis and adapted to selectively receive said needle, positioning means operable to reciprocate said needle relative to said chassis between a first position in engagement with said yarn-receiving assembly and a second position remote from said yarn-receiving assembly, a ratchet gear rotatably mounted to said chassis and having numerals sequentially printed at its periphery, a resilient actuator mounted to said needle and located to advance said ratchet gear as said needle moves from said second position to said first position, a pawl engaging said ratchet gear, said pawl being constructed and arranged to prevent said ratchet gear from counter-rotating as said needle moves from said first position to said second position, and a stop-piece adjustably mounted within said chassis and constructed and arranged so that said stop-piece limits the reciprocation of said needle as said needle moves from said first position to said second position.

* * * * *